US005530395A

United States Patent [19]

Ting

[11] Patent Number: 5,530,395

[45] Date of Patent: Jun. 25, 1996

[54] SUPPLY VOLTAGE LEVEL CONTROL USING REFERENCE VOLTAGE GENERATOR AND COMPARATOR CIRCUITS

[75] Inventor: Tah-Kang J. Ting, Hsinchu, Taiwan

[73] Assignee: Etron Technology Inc., Hsinchu, Taiwan

[21] Appl. No.: 415,322

[22] Filed: Apr. 3, 1995

[51] Int. Cl.[6] ..... G05F 3/02

[52] U.S. Cl. ..... 327/543; 327/538; 327/72

[58] Field of Search ..... 327/142, 143, 327/52, 53, 543, 538, 540, 541, 545, 546, 72, 103, 78; 323/313, 314

[56] References Cited

U.S. PATENT DOCUMENTS

| | | | |
|---|---|---|---|
| 4,095,164 | 6/1978 | Ahmed | 323/8 |
| 4,309,627 | 1/1982 | Tabata | 327/143 |
| 4,469,957 | 9/1984 | Krüger | 327/143 |
| 4,663,584 | 5/1987 | Okada et al. | 323/313 |
| 4,939,442 | 7/1990 | Carvajal et al. | 323/314 |
| 4,970,415 | 11/1990 | Fitzpatrick et al. | 323/313 |
| 5,287,011 | 2/1994 | Koshikawa et al. | 327/143 |
| 5,373,226 | 12/1994 | Kimura | 323/313 |

FOREIGN PATENT DOCUMENTS

| | | | |
|---|---|---|---|
| 3-249817 | 11/1991 | Japan | 327/143 |
| 4-3513 | 1/1992 | Japan | 327/143 |

*Primary Examiner*—Timothy P. Callahan
*Assistant Examiner*—Terry L. Englund
*Attorney, Agent, or Firm*—George O. Saile; Larry J. Prescott

[57] ABSTRACT

A voltage level detection circuit is described which can detect changes in a supply voltage level. A difference voltage generating circuit produces a voltage across the two terminals of a resistor which is a function of the supply voltage level. The voltage at each terminal of the resistor are fed to the inputs of an unbalanced comparator. The output voltage of the unbalanced comparator provides a voltage signal related to the supply voltage level which can be used to detect changes in the supply voltage level, compensate for changes in the supply voltage level, or the like.

7 Claims, 3 Drawing Sheets

SUPPLY VOLTAGE LEVEL CONTROL USING REFERENCE VOLTAGE GENERATOR AND COMPARATOR CIRCUITS

BACKGROUND OF THE INVENTION (1) Field of the Invention

This invention relates to a circuit which can detect a supply voltage level without the need for a complicated reference level.

(2) Description of Related Art

In large scale integrated circuits such as static random access memory, dynamic random access memory and the like the supply voltage level can vary by ±10% or greater. The supply voltage level is often critical to proper circuit operation and must be detected and controlled. In many circuits used to detect and control the supply voltage levels complicated circuits and complicated voltage reference levels are required.

This invention provides a relatively simple circuit for detecting supply voltage levels without the use of complicated reference levels.

SUMMARY OF THE INVENTION

In large scale integrated circuits such as static random access memory, dynamic random access memory, and the like primary supply voltages, such as the $V_{cc}$ supply voltage may have tolerances of ±10% or greater. In addition circuit loading and the type of devices used in the circuits can affect the voltage level of the supply voltages. In some cases the voltage level of the supply voltages can vary during circuit operation. In some circuits the voltage level of the supply voltages may be critical to proper circuit operation. It is therefore important to be able to detect the voltage level of supply voltages which are critical to proper circuit operation.

It is an object of this invention to provide a voltage level detection circuit which can detect the voltage level of a supply voltage without requiring a complicated reference level.

It is a further object of this invention to provide a voltage level detection circuit using a difference voltage derived from a supply voltage wherein changes in the difference voltage are greater than changes in the supply voltage.

These objectives are achieved by means of a difference level generating circuit connected to an unbalanced comparator. The difference voltage generating circuit produces a difference voltage which is proportional to the supply voltage. The unbalanced comparator produces an output voltage which is related to the difference voltage. When the difference voltage generating circuit and the unbalanced comparator are connected together the output voltage is a very sensitive indicator of the supply voltage level and changes in the supply voltage level.

The difference voltage generating circuit is achieved by means of two P channel metal oxide semiconductor field effect transistors, PMOS-FETs, three N channel metal oxide semiconductor field effect transistors, NMOS-FETs, and a resistor all connected in series between the supply voltage and ground. One of the PMOS-FETs and two of the NMOS-FETs are connected in diode mode so that the voltage drop across them is the threshold voltage of the device. The remaining PMOS-FET and NMOS-FET are added to improve the current regulation of the circuit. The difference voltage is the voltage across the resistor and is directly proportional to the supply voltage.

The voltage at one terminal of the resistor is fed to one input of an unbalanced comparator and the voltage at the other terminal of the resistor is connected to the other input of the unbalanced comparator. The voltage drop across the resistor is the difference voltage, is the difference voltage input to the unbalanced comparator, and is proportional to the supply voltage. The difference voltage is connected to the comparator such that the output voltage of the unbalanced comparator is always positive. The output voltage of the unbalanced comparator is an indicator of the supply voltage level. The output voltage of the unbalanced comparator is thereby a detector of the supply voltage level.

DESCRIPTION OF THE PREFERRED EMBODIMENTS

Figure 1A:
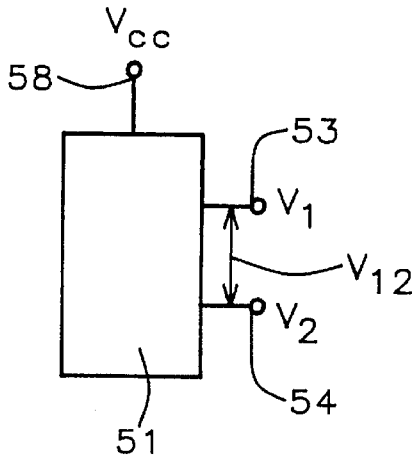
FIG. 1A Prior Art
FIG. 1A is a block diagram of a circuit which produces a difference voltage output proportional to the supply voltage.

Refer now to FIG. 1A through FIG. 1D, there is shown an embodiment of the voltage level detection circuit of this invention. FIG. 1A shows a block diagram 51 of the difference voltage generating circuit. The $V_{cc}$ supply voltage is connected to the supply voltage terminal 58 of the difference voltage generating circuit 51. A voltage $V_1$ is produced at the first output terminal 53 of the difference voltage generating circuit 51 and a voltage $V_2$ is produced at the second output terminal 54 of the difference voltage generating circuit 51. The voltage drop, $V_{12}$, between the first output terminal 53 and the second output terminal 54 of the difference voltage generating circuit 51 is equal to $V_1$minus $V_2$ and is proportional to the $V_{cc}$ supply voltage. The circuit is arranged so that $V_1$ is equal to or greater than $V_2$ so that $V_{12}$ is never less than zero.

Figure 1B:
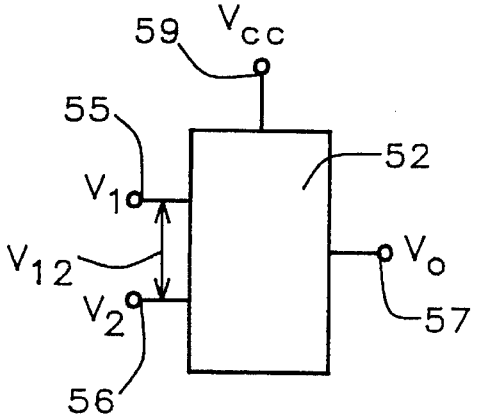
FIG. 1B Prior Art
FIG. 1B is a block diagram of a circuit which produces an output voltage related to a difference voltage input.

FIG. 1B shows a block diagram 52 of the unbalanced comparator. The difference voltage, $V_{12}$, produced by the difference voltage generating circuit is connected to the input terminals 55 and 56 of the unbalanced comparator 52. The output voltage, $V_o$, produced at the output terminal 57 of the unbalanced comparator 52 is related to the difference voltage, $V_{12}$, as shown by the curve 70 in FIG. 1C. Since the difference voltage, $V_{12}$, is proportional to the supply voltage, $V_{cc}$ , the output voltage, $V_o$, is an indicator of the supply voltage, $V_{cc}$. The supply voltage, $V_{cc}$, also supplies the unbalanced comparator 52 and is connected to the input terminal 59 of the unbalanced comparator 52. The difference voltage, $V_{12}$, is connected to the unbalanced comparator so that the output voltage, $V_o$, is never negative.

Figure 1C:
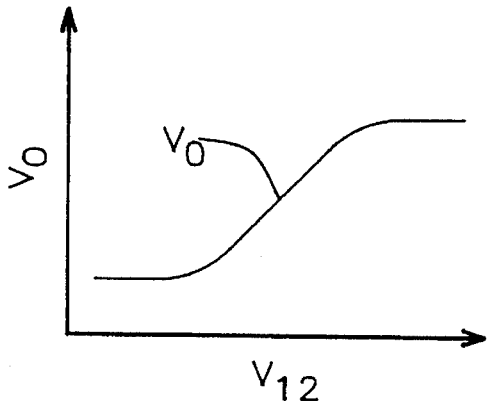
FIG. 1C is a curve of the output voltage of the voltage level detection circuit as a function of the difference voltage.
Figure 1D:
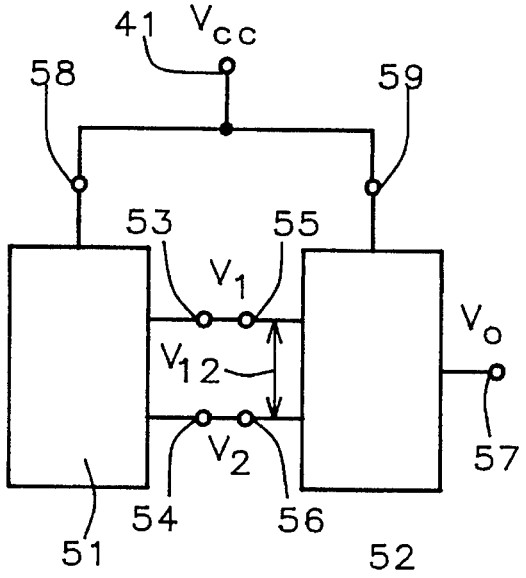
FIG. 1D Prior Art
FIG. 1D is a block diagram of a voltage level detection circuit which produces an output voltage related to the supply voltage.

FIG. 1D shows a block diagram of the difference voltage generator 51 connected to the unbalanced comparator 52 to form the block diagram of the voltage level detection circuit.

Figure 2:
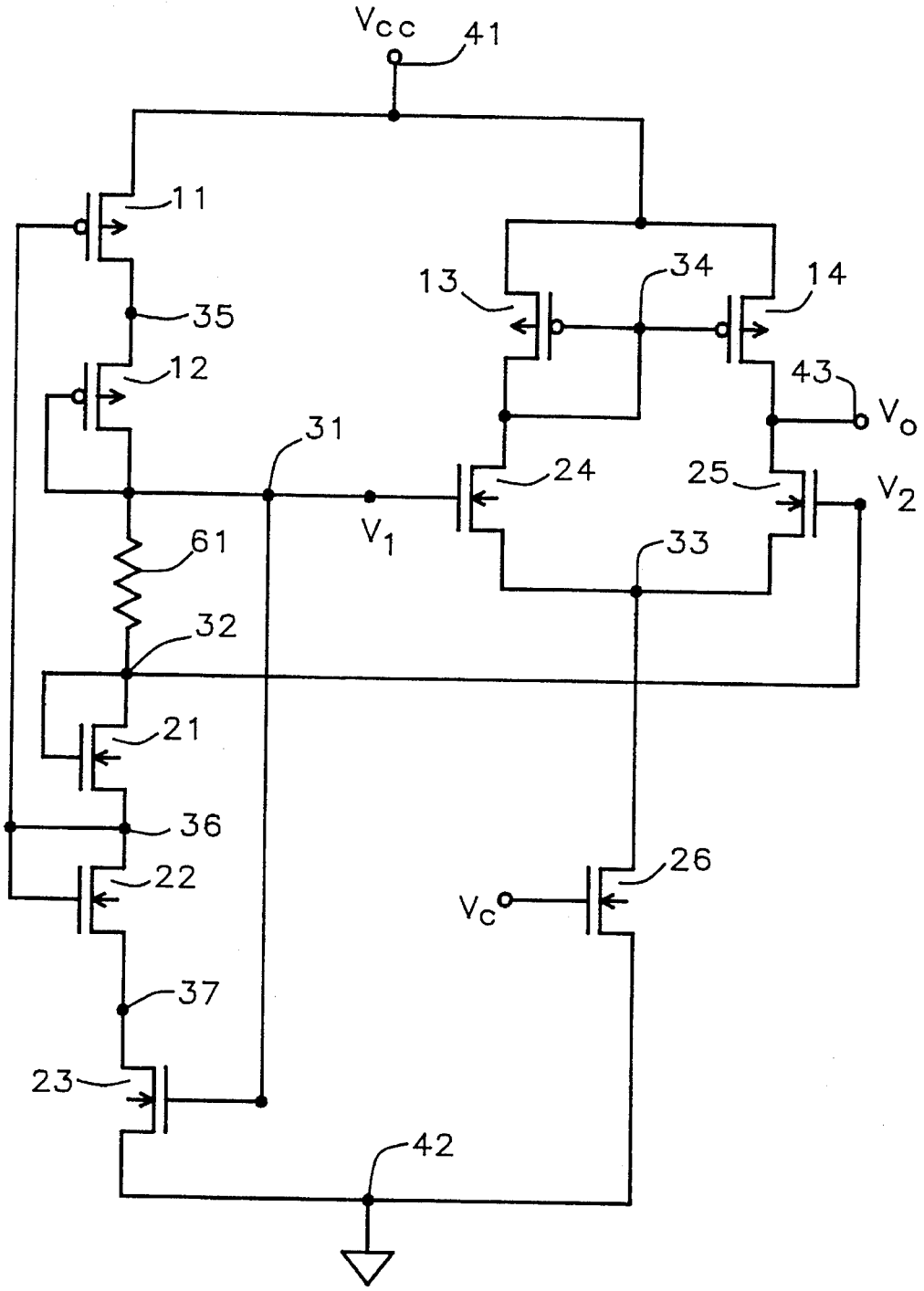
FIG. 2 is a schematic diagram of the voltage level detection circuit.
Figure 3:
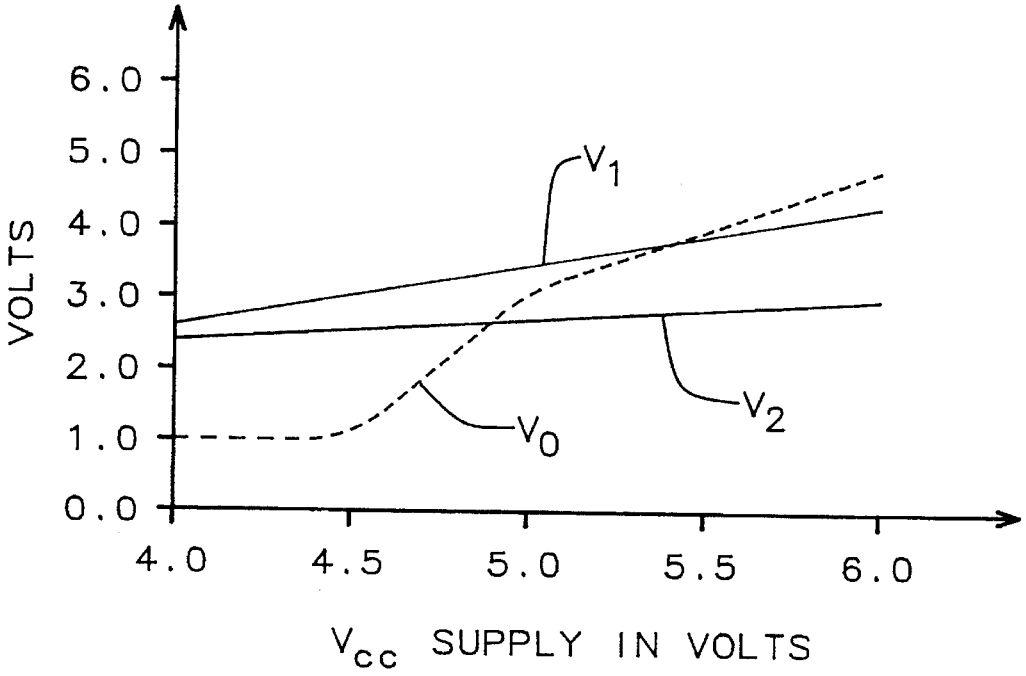
FIG. 3 shows the results of a computer simulation of the voltage level detection circuit showing the voltage at each terminal of the resistor and the output voltage of the unbalanced comparator each as a function of the supply voltage.

Refer now to FIG. 2 and FIG. 3, there is shown a schematic diagram of the preferred embodiment of the voltage level detection circuit of this invention. As shown in FIG. 2 the level detection circuit is comprised of a first 11, second 12, third 13, and fourth 14 P channel metal oxide semiconductor field effect transistors, or PMOS-FETs, each PMOS-FET having a drain, a source, and a gate; a first 21, second 22, third 23, fourth 24, fifth 25, and sixth 26 N channel metal oxide semiconductor field effect transistor, or NMOS-FET, each NMOS-FET having a drain, a source, and a gate; a resistor 61 of about 30,000 ohms; a first 31, second 32, third 33, fourth 34, fifth 35, sixth 36, and seventh 37 node; a $V_{cc}$ supply voltage node 41; a ground node 42; and an output voltage node 43.

The source of the first PMOS-FET 11 is connected to the $V_{cc}$ voltage supply node 41, the drain of the first PMOS-FET 11 is connected to the fifth node 35, and the gate=of the first PMOS-FET 11 is connected to the sixth node 36. The source of the second PMOS-FET 12 is connected to the fifth node 35, the drain of the second PMOS-FET 12 is connected to the first node 31, and the gate of the second PMOS-FET 12 is connected to the first node 31. The first terminal of the resistor 61 is connected to the first node 31 and the second terminal of the resistor 61 is connected to the second node 32. The drain of the first NMOS-FET 21 is connected to the second node 32, the source of the first NMOS-FET 21 is connected to the sixth node 36, and the gate of the first NMOS-FET 21 is connected to the second node 32. The drain of the second NMOS-FET 22 is connected to the sixth node 36, the source of the second NMOS-FET 22 is connected to the seventh node 37, and the gate of the second NMOS-FET 22 is connected to the sixth node 36. The drain of the third NMOS-FET 23 is connected to the seventh node 37, the source of the third NMOS-FET 23 is connected to the ground node 42, and the gate of the third NMOS-FET 23 is connected to the first node 31. The second PMOS-FET 12, the resistor 61, and the first 21 and second 22 NMOS-FETs make up a divider circuit between the $V_{cc}$ supply voltage and ground. The first PMOS-FET 11 and the third NMOS-FET 13 are added to provide superior current regulation to the circuit. This circuit forms the difference voltage generating circuit described above. The voltage at the first node 31 is the voltage $V_1$ and the voltage at the second node 32 is the voltage $V_2$. The voltage drop across the resistor 61 is the difference voltage $V_{12}$ and is equal to $V_1$ minus $V_2$.

To form the unbalanced comparator the source of the third PMOS-FET 13 is connected to the $V_{cc}$ voltage supply node 41, the drain of the third PMOS-FET 13 is connected to the fourth node 34, and the gate of the third PMOS-FET 13 is connected to the fourth node 34. The source of the fourth PMOS-FET 14 is connected to the $V_{cc}$ voltage supply node 41, the drain of the fourth PMOS-FET 14 is connected to the output voltage node 43, and the gate of the fourth PMOS-FET 14 is connected to the fourth node 34. The drain of the fourth NMOS-FET 24 is connected to the fourth node 34, the source of the fourth NMOS-FET 24 is connected to the third node 33, and the gate of the fourth NMOS-FET 24 is connected to the first node 31 which is one of the inputs of the unbalanced comparator. The drain of the fifth NMOS-FET 25 is connected to the output voltage node 43, the source of the fifth NMOS-FET 25 is connected to the third node 33, and the gate of the fifth NMOS-FET 25 is connected to the second node 32 which is the other input of the unbalanced comparator. The drain of the sixth NMOS-FET 26 is connected to the third node 33 and the source of the sixth NMOS-FET 26 is connected to the ground node 42. The gate of the sixth NMOS-FET 26 is connected to a control signal $V_c$ which keeps the sixth NMOS-FET 26 turned on and does not affect the invention herein described. The voltage at the output voltage node 43 of the unbalanced comparator serves as an indicator of the $V_{cc}$ voltage supply level.

The size of the fifth NMOS-FET 25 is greater than that of the fourth NMOS-FET 24. This determines the characteristic voltage, $V_c$, of the unbalanced comparator and also causes the unbalance in the unbalanced comparator. For a balanced comparator the characteristic voltage is zero and for the unbalanced comparator of this invention the characteristic voltage is different than zero. Refer now to FIG. 1A and FIG. 1B, there is shown a block diagram which is useful in understanding the operation of the voltage level detection circuit of this invention. FIG. 1A shows a block diagram of the difference voltage generating circuit 51 which provides the voltage $V_1$ at the first output 53 of the difference voltage generating circuit 51 and the voltage $V_2$ at the second output 54 of the difference voltage generating circuit 51. For a certain change in the supply voltage, $V_{cc}$, the difference voltage generating circuit 51 produces a change in the difference voltage, $V_{12}$ equal to $V_1$ minus $V_2$, appearing at the output terminals 53 and 54. The outputs of the difference voltage generating circuit $V_1$ and $V_2$ are biased at the proper input level for the unbalanced comparator circuit 52 shown as a block diagram in FIG. 1B.

FIG. 1B shows a block diagram of the unbalanced comparator circuit 52 with the input voltages $V_1$ and $V_2$. The voltage $V_1$ is always greater than $V_2$ so that $V_1$ minus $V_2$ or $V_{12}$ is always positive. The unbalanced comparator compares the difference voltage, $V_{12}$, with a characteristic voltage, $V_c$, of the unbalanced comparator, which is a function of the $V_{cc}$ supply voltage. Referring now to FIG. 1C, the output voltage 70 of the unbalanced comparator is low when the difference voltage is less than the characteristic voltage and high when the difference voltage is greater than the characteristic voltage. The output of the unbalanced comparator switches when $V_{cc}$ is about 4.6 volts and the difference voltage, $V_{12}$, is about 0.3 volts. The difference voltage is more sensitive to changes in $V_{cc}$ than is the characteristic voltage. The characteristic voltage comes from the unbalanced comparator design wherein two transistors are of different sizes. For a balanced comparator the characteristic voltage is zero and for the unbalanced comparator of this invention the characteristic voltage is different than zero.

The $V_{cc}$ supply voltage is between about 4 volts and 5 volts. The second PMOS-FET 12, resistor 61, first NMOS-FET 21, and second NMOS-FET 22 form a voltage divider between the $V_{cc}$ supply voltage 41 and ground 42. The first PMOS-FET 11 and third NMOS-FET 23 are added to improve current regulation. The second PMOS-FET 12, first NMOS-FET 21, and second NMOS-FET 22 are connected in diode mode with the gate of the second PMOS-FET 12 tied to the drain of the second PMOS-FET 12, the drain of the first NMOS-FET 21 tied to the gate of the first NMOS-FET 21, and the drain of the third NMOS-FET 23 tied to the gate of the third NMOS-FET 23. With the second PMOS-FET 12 and second 22 and third 23 NMOS-FETs in diode mode the voltage drop across each of the FETs will be nearly equal to the threshold voltage of the FET. The voltage across the resistor 61 will be proportional to the current in the resistor 61 which will be proportional to the $V_{cc}$ supply voltage 41 so the voltage across the resistor 61 will be directly proportional to the $V_{cc}$ supply voltage 41.

The voltage at the first terminal of the resistor, or at the first node 31, is $V_1$ and is fed to the gate of the fourth NMOS-FET 24. The voltage at the second terminal of the resistor, or at the second node 32, is $V_2$ and is fed to the gate of the fifth NMOS-FET 35. The unbalanced comparator circuit produces a voltage at the output voltage node 43 which is related to the difference voltage $V_{12}$ which is $V_1$ minus $V_2$. The difference voltage, $V_{12}$, the voltage drop across the resistor 61 and is directly proportional to the $V_{cc}$ supply voltage.

The circuit of FIG. 2 described above is the preferred design of the voltage level detection circuit for a $V_{cc}$ supply voltage level of between about 4 and 5 volts. The key elements of the circuit are the second PMOS-FET 12, the first 21 and second 22 NMOS-FETs, and the resistor 61. The first PMOS-FET 11 and third NMOS-FET 23 have been added to provide superior current regulation to the circuit. If it were desired to have a lower $V_{cc}$ supply voltage than 4 volts either the first 21 or second 22 NMOS-FET could be removed from the circuit.

The second PMOS-FET 12, the first 21 and second 22 NMOS-FETs, and the resistor 61 must be carefully chosen to provide the proper difference voltage, $V_{12}$, and to minimize power consumption. If higher power consumption can be tolerated greater response speed can be achieved by using larger transistors and a lower value of resistance. For example, for state of the art MOS-FET devices the resistor can range from between about 10,000 ohms to 100,000 ohms.

FIG. 3 shows computer simulation results of voltage level detection circuit of this invention. The curves in FIG. 3 are the computer simulation results of the voltage at the first node $V_1$, the voltage at the second node $V_2$, and the voltage at the output voltage node $V_o$ as a function of the $V_{cc}$ supply voltage. At a $V_{cc}$ level of 4.6 volts the difference voltage, $V_{12}$ equal to $V_1$ minus $V_2$, is about 0.3 volts and is the point where the output voltage switches from a low value to a high value. The difference voltage, $V_{12}$, is a function of $V_{cc}$ which is more sensitive to $V_{cc}$ change than is the characteristic voltage of the unbalanced comparator circuit.

The sensitivity of the voltage at the output voltage node to the $V_{cc}$ supply voltage is at least 2.2 volts/volt in the range of $V_{cc}$ supply voltage between about 4.5 volts and 5.5 volts. This provides the ability to readily detect the $V_{cc}$ supply voltage level by monitoring the voltage at the output voltage node. The voltage at the output voltage node can be used by other circuits to monitor and make adjustments for changes in the $V_{cc}$ supply voltage. The curve of the output voltage $V_o$ in FIG. 3 will have a sharper transition between low voltage and high voltage if the output voltage is connected to the input of an inverter and the output of the inverter used as the output voltage of the voltage level detection circuit.

While the invention has been particularly shown and described with reference to the preferred embodiments thereof, it will be understood by those skilled in the art that various changes in form and details may be made without departing from the spirit and scope of the invention.

What is claimed is:

1. A voltage level detection circuit, comprising:

a power supply input node;

a first output node;

a second output node;

a voltage source connected to said power supply input node;

an output voltage node;

a third node;

a fourth node;

a fifth node;

a ground node;

a first P channel metal oxide semiconductor field effect transistor having a gate, a source, and a drain wherein said source of said first P channel metal oxide semiconductor field effect transistor is connected to said power supply input node, said drain of said first P channel metal oxide semiconductor field effect transistor is connected to said third node, and said gate of said first P channel metal oxide semiconductor field effect transistor is connected to said fourth node;

a second P channel metal oxide semiconductor field effect transistor having gate, a source, and a drain wherein said source of said second P channel metal oxide semiconductor field effect transistor is connected to said third node, said drain of said second P channel metal oxide semiconductor field effect transistor is connected to said first output node, and said gate of said second P channel metal oxide semiconductor field effect transistor is connected to said first output node;

a resistor having a first terminal and a second terminal wherein said first terminal is connected to said first output node and said second terminal is connected to said second output node so that a difference voltage is a voltage drop across said resistor;

a first N channel metal oxide semiconductor field effect transistor having a gate, a source, and a drain wherein said drain of said first N channel metal oxide semiconductor field effect transistor is connected to said second output node, said source of said first N channel metal oxide semiconductor field effect transistor is connected to said fourth node, and said gate of said first N channel metal oxide semiconductor field effect transistor is connected to said second output node;

a second N channel metal oxide semiconductor field effect transistor having gate, a source, and a drain wherein said drain of said second N channel metal oxide semiconductor field effect transistor is connected to said fourth node, said source of said second N channel metal oxide semiconductor field effect transistor is connected to said fifth node, and said gate of said second N channel metal oxide semiconductor field effect transistor is connected to said fourth node;

a third N channel metal oxide semiconductor field effect transistor having a gate, a source, and a drain wherein said drain of said third N channel metal oxide semiconductor field effect transistor is connected to said fifth node, said source of said third N channel metal oxide semiconductor field effect transistor is connected to said ground node, and said gate of said third N channel metal oxide semiconductor field effect transistor is connected to said first output node; an means connected to said first output node and said second output node for producing an output voltage at said output voltage node wherein said output voltage is at a high voltage level when the voltage drop from said first output node to said second output node is greater than a reference voltage and said output voltage is at a low voltage level when the voltage drop from said first output node to said second output node is less than said reference voltage.

2. The voltage level detection circuit of claim 1 wherein changes in a voltage at said power supply input node result in changes in the voltage drop from said first output node to said second output node which are related to said changes in said voltage at said power supply input node.

3. The voltage level detection circuit of claim 1 wherein said resistor has a resistance of between about ten thousand ohms and one hundred thousand ohms.

4. The voltage level detection circuit of claim 1 wherein said resistor has a resistance of about thirty thousand ohms.

5. A difference voltage generating circuit, comprising:

a power supply input node;

a first output node;

a second output node;

a voltage source connected to said power supply input node;

third node;

a fourth node;

a fifth node;

a ground node;

a first P channel metal oxide semiconductor field effect transistor having a gate, a source, and a drain wherein said source of said first P channel metal oxide semiconductor field effect transistor is connected to said power supply input node said drain of said first P channel metal oxide semiconductor field effect transistor is connected to said third node, and said gate of said first P channel metal oxide semiconductor field effect transistor is connected to said fourth node;

a second P channel metal oxide semiconductor field effect transistor having a gate, a source, and a drain wherein said source of said second P channel metal oxide semiconductor field effect transistor is connected to said third node, said drain of said second P channel metal oxide semiconductor field effect transistor is connected to said first output node, and said gate of said second P channel metal oxide semiconductor field effect transistor is connected to said first output node;

a resistor having a first terminal and a second terminal wherein said first terminal is connected to said first output node and said second terminal is connected to said second output node so that a difference voltage is a voltage drop across said resistor;

a first N channel metal oxide semiconductor field effect transistor having a gate, a source, and a drain wherein said drain of said first N channel metal oxide semiconductor field effect transistor is connected to said second output node, said source of said first N channel metal oxide semiconductor field effect transistor is connected to said fourth node, and said gate of said first N channel metal oxide semiconductor field effect transistor is connected to said second output node;

a second N channel metal oxide semiconductor field effect transistor having a gate, a source, and a drain wherein said drain of said second N channel metal oxide semiconductor field effect transistor is connected to said fourth node, said source of said second N channel metal oxide semiconductor field effect transistor is connected to said fifth node, and said gate of said second N channel metal oxide semiconductor field effect transistor is connected to said fourth node; and a third N channel metal oxide semiconductor field effect transistor having a gate, a source, and a drain wherein said drain of said third N channel metal oxide semiconductor field effect transistor is connected to said fifth node, said source of said third N channel metal oxide semiconductor field effect transistor is connected to said ground node, and said gate of said third N channel metal oxide semiconductor field effect transistor is connected to said first output node.

6. The difference voltage generating circuit of claim 5 wherein said resistor has a resistance of between about ten thousand ohms and one hundred thousand ohms.

7. The difference voltage generating circuit of claim 5 wherein said resistor has a resistance of about thirty thousand ohms.

* * * * *